US006330990B1

(12) United States Patent
Haubrich

(10) Patent No.: US 6,330,990 B1
(45) Date of Patent: Dec. 18, 2001

(54) UNIVERSAL MECHANICAL BAG HOLDER

(76) Inventor: Raymond Haubrich, 1089 Forest Ave., Des Plaines, IL (US) 60076

( * ) Notice: Subject to any disclaimer, the term of this patent is extended or adjusted under 35 U.S.C. 154(b) by 0 days.

(21) Appl. No.: 09/431,377

(22) Filed: Nov. 1, 1999

(51) Int. Cl.[7] ..... B65B 67/04; B62B 1/00

(52) U.S. Cl. ..... 248/99; 248/101; 280/47.28; 280/654

(58) Field of Search ..... 248/99, 95, 97, 248/98, 101, 128, 129, 146; 280/47.34, 654, 47.28

(56) References Cited

U.S. PATENT DOCUMENTS 1,788,132 * 1/1931 Topper ..... 248/99
3,754,771 * 8/1973 Shagoury ..... 280/654
3,773,286 * 11/1973 Govoni et al. ..... 248/97
3,838,839 * 10/1974 Spencer ..... 248/99
4,202,521 * 5/1980 Harding ..... 248/98
4,358,083 11/1982 Haubrich .
4,452,468 * 6/1984 Eads et al. ..... 280/641
4,917,393 * 4/1990 Rogers ..... 280/47.28
4,940,201 * 7/1990 Kurth ..... 248/101
5,380,033 * 1/1995 Harling ..... 280/654

* cited by examiner

*Primary Examiner*—Anita King
(74) *Attorney, Agent, or Firm*—Adrienne B. Naumann, Esq.

(57) ABSTRACT

My invention comprises a mechanical universal bag holding device. More particularly, my bag holding device is designed to support a bag which can be expanded and lengthened while filling. My device basically comprises in its most basic embodiment: a cylindrical transverse hollow piping and angled arms which are connected to the hollow pipe and operate as supports for a bag or container. In other embodiments my bag holder can be attached to a dolly in construction work, or manufactured as a smaller version for kitchen use.

7 Claims, 11 Drawing Sheets

UNIVERSAL MECHANICAL BAG HOLDER

BACKGROUND OF THE INVENTION

Figure 1A:
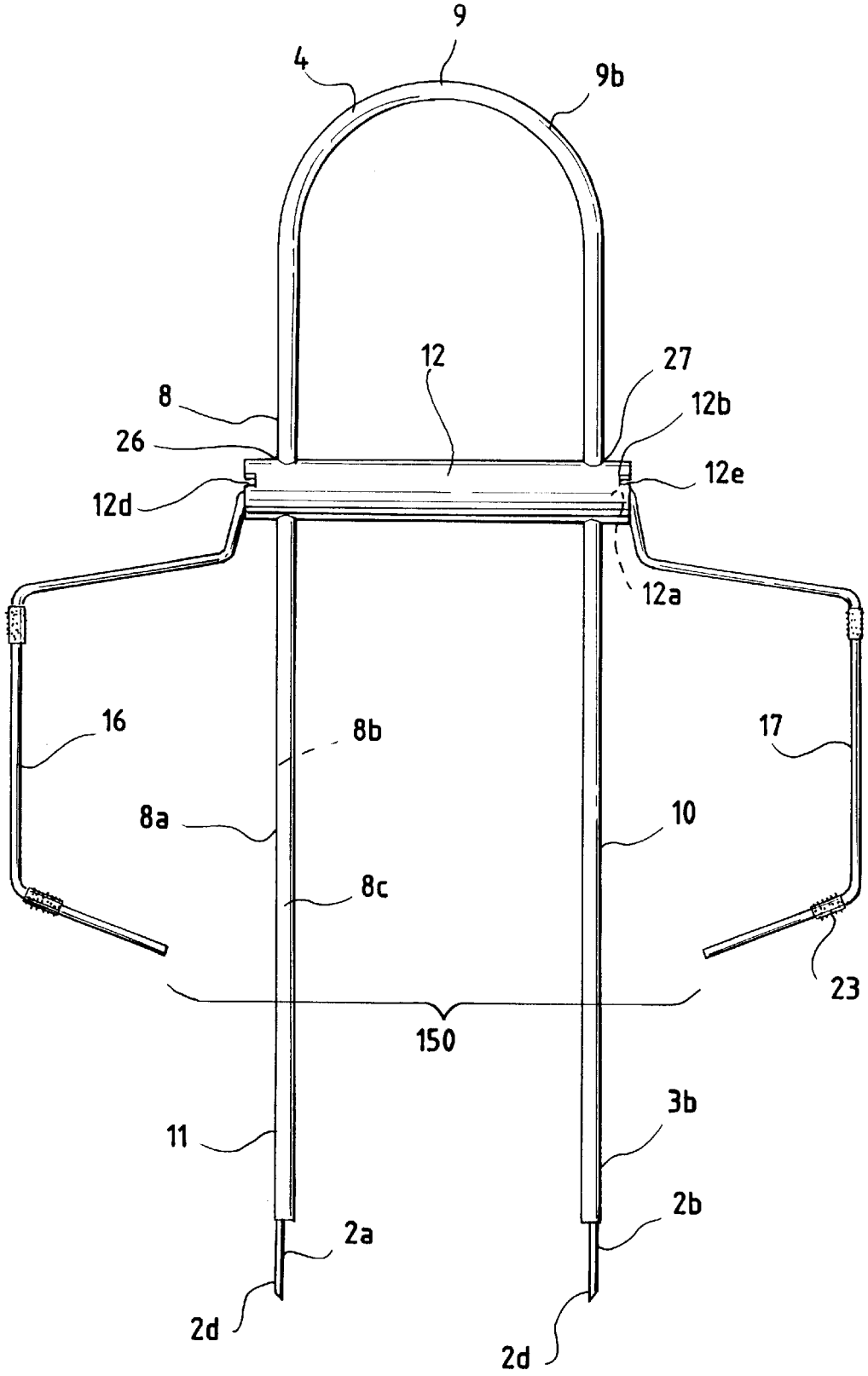

My invention relates in general to a means for holding a fillable bag upright while it is filled with garden refuse, construction debris, kitchen debris or useable materials with a need for transport. Other materials are also appropriate without limitation, if the bag or container is not chemically damaged by such contents. In particular my invention relates to an mechanical apparatus which maintains a bag or container in an open and upright position while it is filled manually from the bottom upwardly.

My apparatus, hereinafter referred to as an improved modified universal adjustable bag holder, can be inserted into the ground to support and hold a bag open in the preferred embodiment. However, other embodiments which need not be inserted into the ground are also within the scope of my invention. Another embodiment of my invention comprises a vertical support which can support a bag or container in an upright position on both the front and back sides of the vertical support.

My bag holder in the preferred embodiment has ground-engagable feet and adjustable angled arms over which the bag or container is positioned and fastened. The angled arms are moved vertically by an adjustment by which the angled arms are physically connected.

In the preferred embodiment polyvinyl chloride piping (PCV), most preferably hollow and with an inner diameter of approximately 2 and ½ inches throughout, is the construction material of choice for the bag raising mechanism. However, embodiments composed of other materials such as steel tubing or hollow wooden segments are acceptable if they possess requisite strength, rigidity, and/or resilience. Combinations of these materials are acceptable as well in other embodiments.

In the preferred embodiment the two angled arms are generally open and parallel to the ground. The arms form a circumference of approximately 36 inches. The arms have a diameter of approximately 26.0 inches when the arms are in their most open position. However my invention is not limited to this particular diameter or circumference. The diameter and circumference may be varied depending upon the particular use and the diameter of the bags or containers. Also, the diameter can be changed by manually adjusting the angles of the two arms.

When the two angled arms are parallel to the ground, there is an gap remaining in the most anterior portion of the circumference, and with no pipe or other support whatsoever. This opening facilitates the removal and attachment of a bag to the angled horizonal arms, as well as widthwide bag expansion.

In the preferred embodiment there are also attachments on both angled arms. Preferably these attachments ares detachable VELCRO® hook and loop fastener tabs which prevent the bag from slipping or collapsing during use.

Other devices are ubiquitous in the prior art. In U.S. Pat. No. 4,358,083 (Haubrich), a device was described with a fully circumscribed hoop, removable bag attachments, and ground engaging feet. T-shaped members were movably mounted on a cross bar for adjusting the size of the metal hoop.

SUMMARY OF THE INVENTION

In the preferred embodiment, my universal bag holder is adapted for use in construction areas for containing debris (ie., a contractor's bag). The more the user pulls on the bag the tighter the bag fits into the apparatus. A square bag holder is also within my invention with VELCRO® hook and loop fastner tabs instead of tiebacks. For use in construction, a plastic bag is preferable because it can stretch with increasing contents. For example, a 39 (thirty-nine) gallon leaf and grass plastic bag is ideal.

Canvas is also acceptable as well as paper for bag or container construction. Nevertheless, the property of stretch and elasticity is lost when using these materials. The advantage with paper of course, is that it is generally biodegradable, whereas most plastic bags, with notable exceptions are not. The bag or container is attached anteriorly upon the angled arms to a curved vertical support. To construct my preferred bag holder, the materials cost approximately $6.00 per device, excluding labor and collateral costs.

As such, one goal of my invention is to provide an improved bag holding device for construction sites and other uses.

Another goal of my invention is to provide a bag holding device with arms which provide an anterior access to an upright bag or container.

Another goal of my invention is to provide a device which can hold a bag on angled arms on both sides of a vertical curved support structure.

Still another goal of my invention is to provide a bag holding device which can simultaneously allow a plastic bag to stretch horizontally and be raised to its full height vertically.

Still another goal of my invention is to provide a device to hold a suitable bag or container to fill with household goods or other storable items.

These and other functions and goals of my invention will become apparent in the drawings and text accompanying the detailed description of the invention.

Figure 1B:
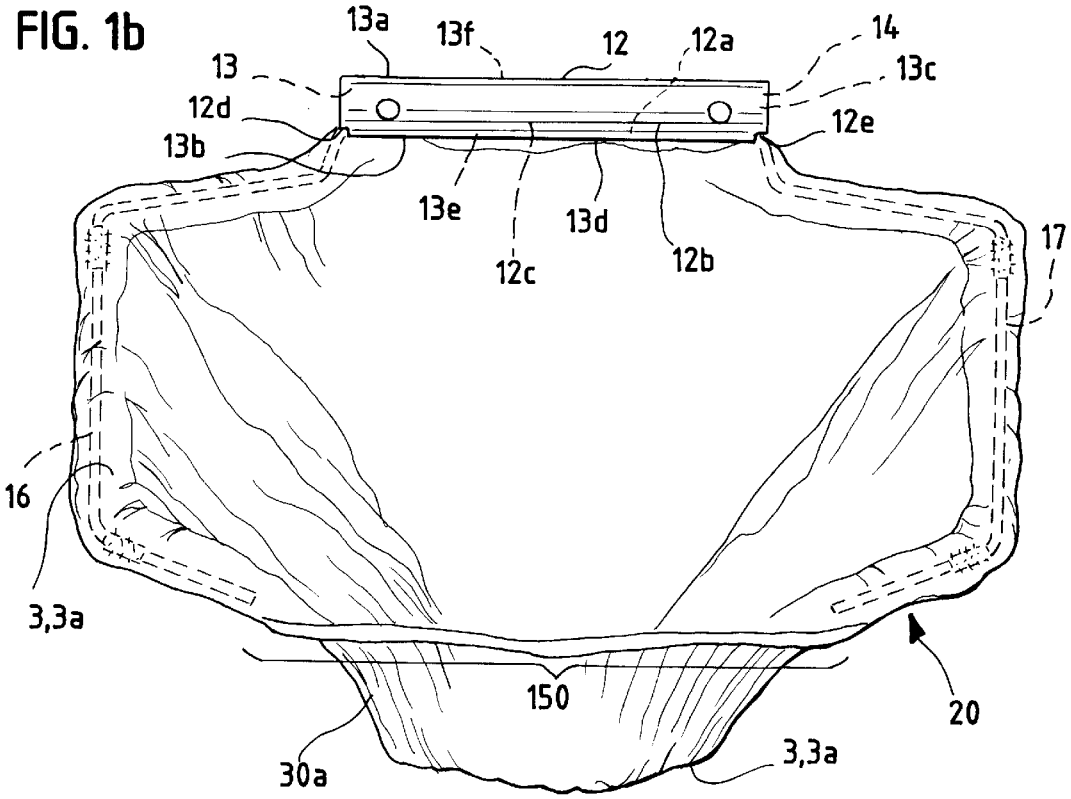

FIG. 1(*a*): Full front view of entire preferred embodiment of universal bag holder with angled arms.

FIG. 1(*b*): Top plan view of isolated transverse cylindrical polyvinyl chloride piping and angled arms illustrating schematic bag pouch.

Figure 2:
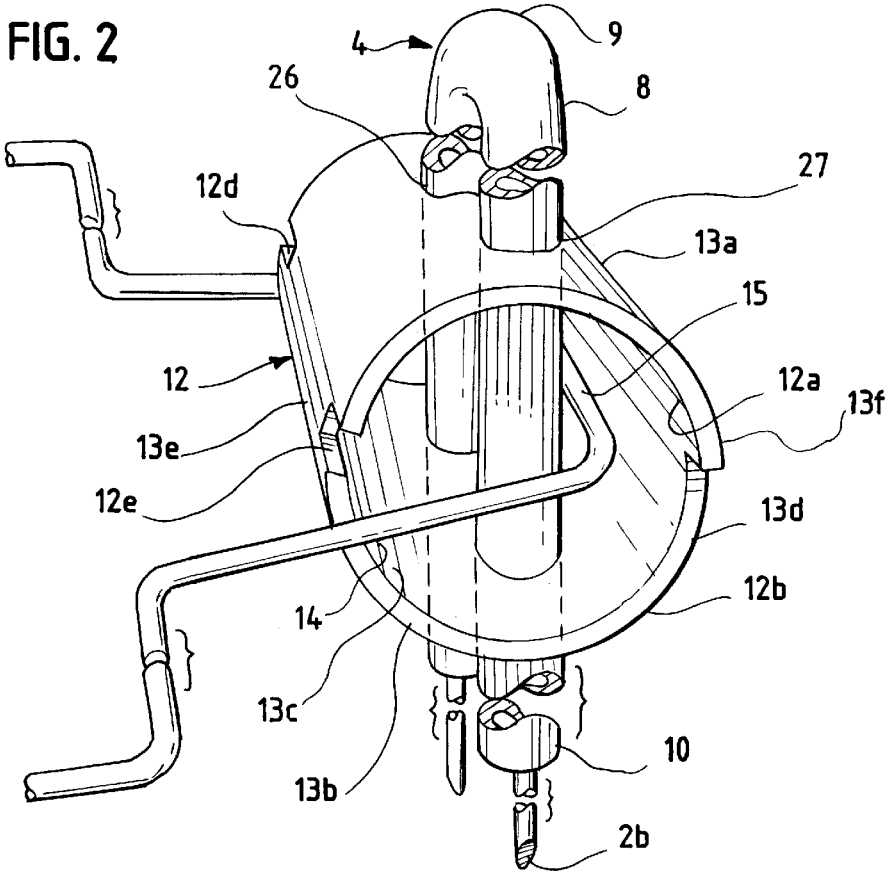

FIG. 2: Partial side view of bag holder with closeup of hollow (PVC) transverse cylindrical piping and its contents.

Figure 3:
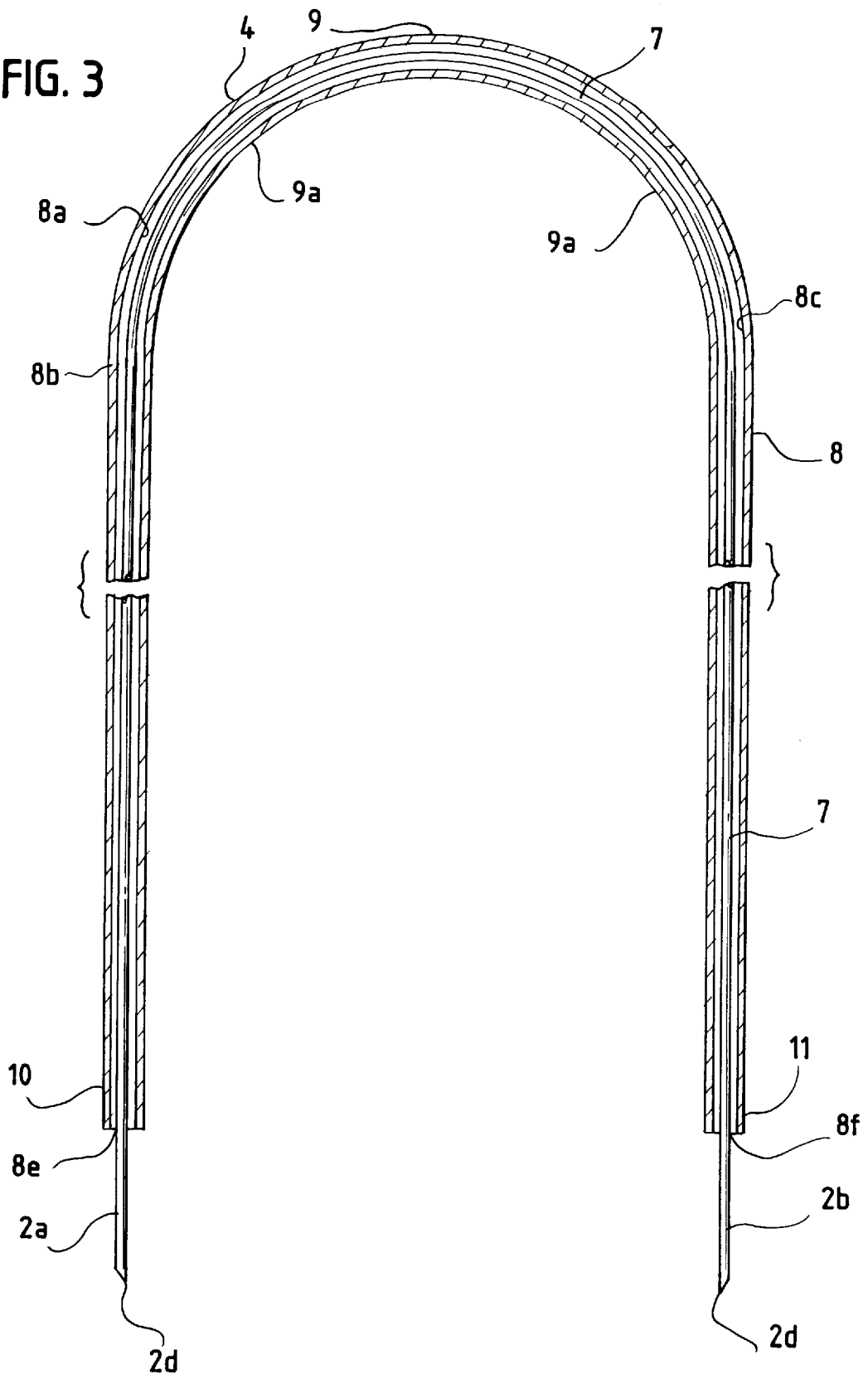

FIG. 3: Full front view of steel conduit vertical support disclosing spring steel rod in phantom.

FIG. 4(*a*): Front view of two sets of angled arms within two PVC hollow transverse rigid cylindrical supports attached to vertical cylindrical rigid support.

FIG. 4(*b*): Full posterior view of vertical rigid cylindrical support with two attachments for bag holders.

FIG. 4(*c*): Side view of rigid vertical cylindrical support with two bag holder attachments.

FIG. 4(*d*): Isolated top plan view of screw attachment for components of second transverse PVC hollow rigid piping.

Figure 5:
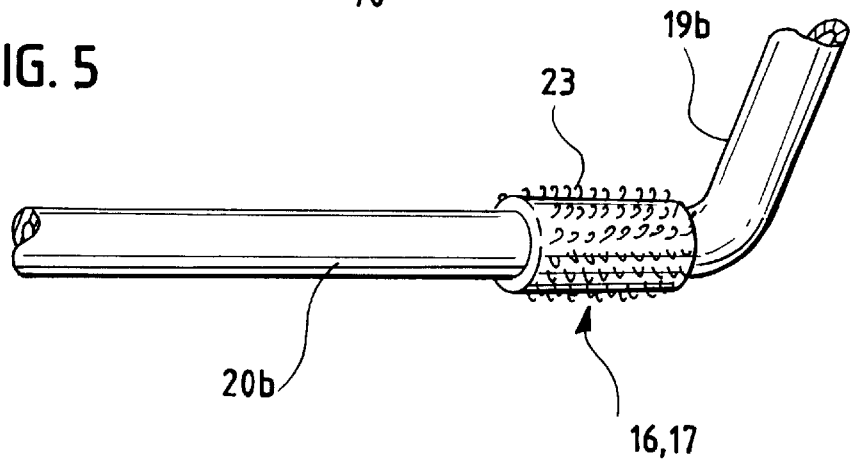

FIG. 5: Closeup front view of VELCRO® hook and loop material attachment on angled arm segment.

Figure 6A:
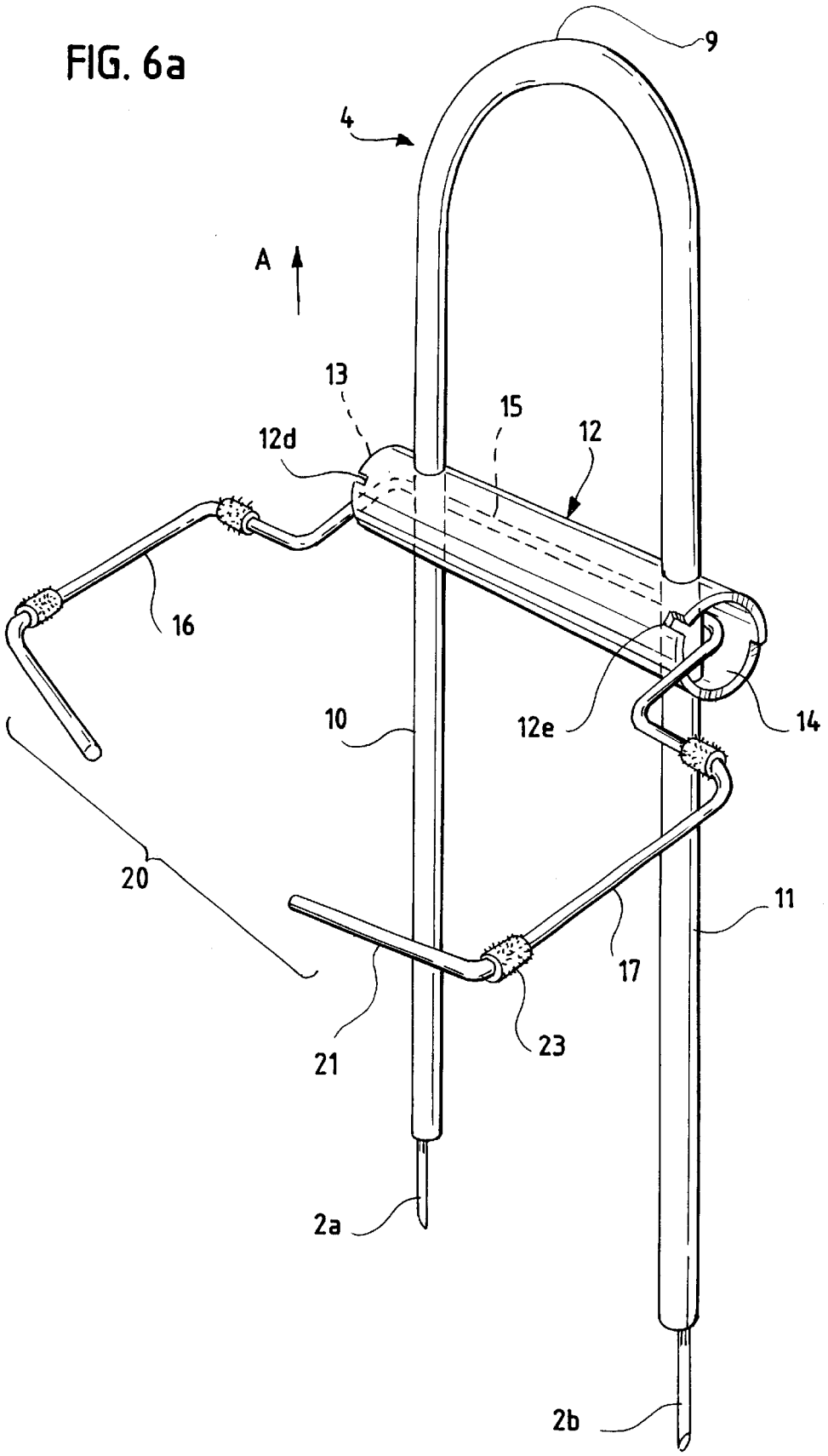
Figure 6B:
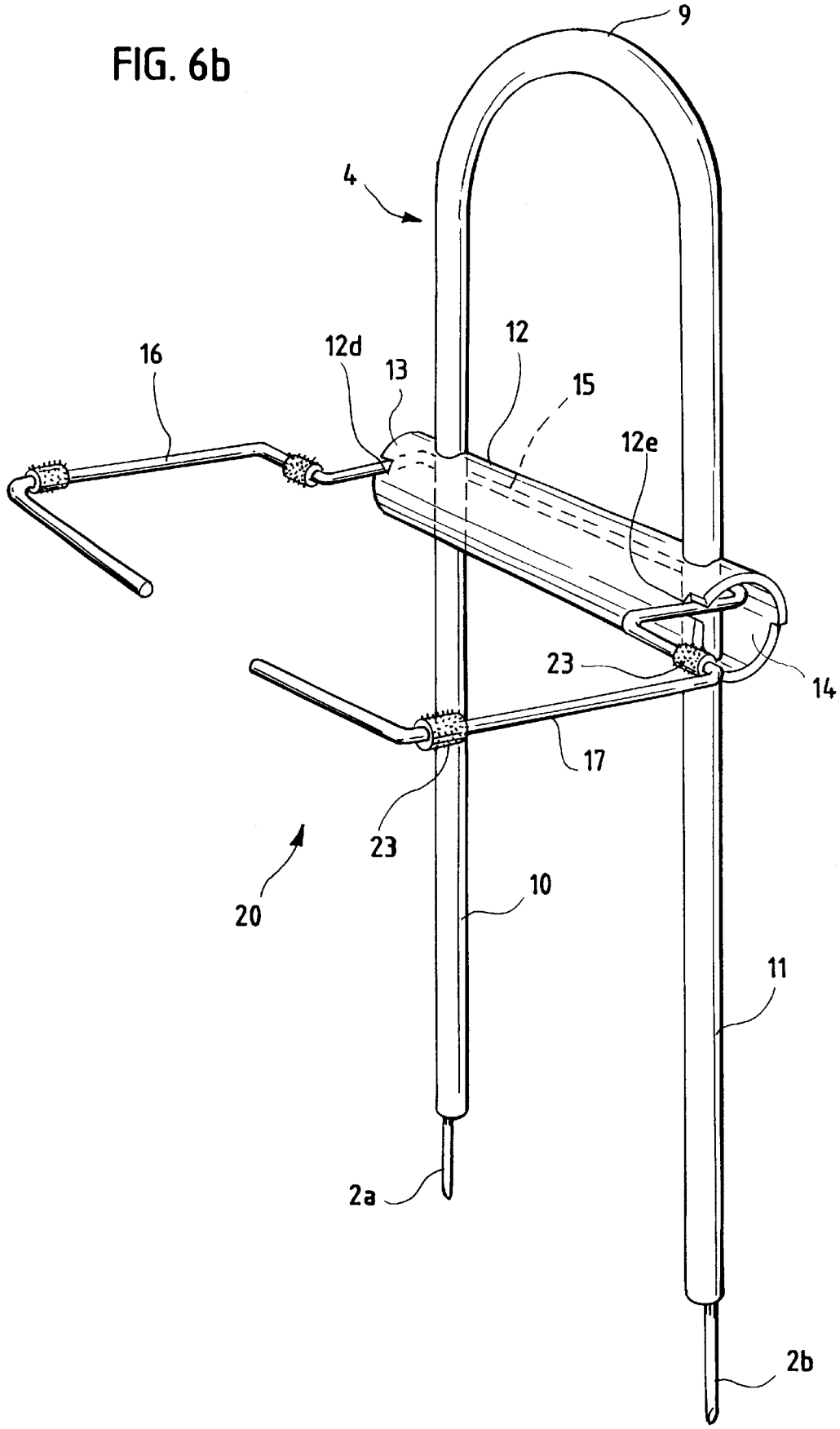

FIG. 6(*a*): Front view of angled arms parallel to a supporting surface.

FIG. 6(*b*): Front view of angled arms demonstrating upper position within notches.

Figure 7:
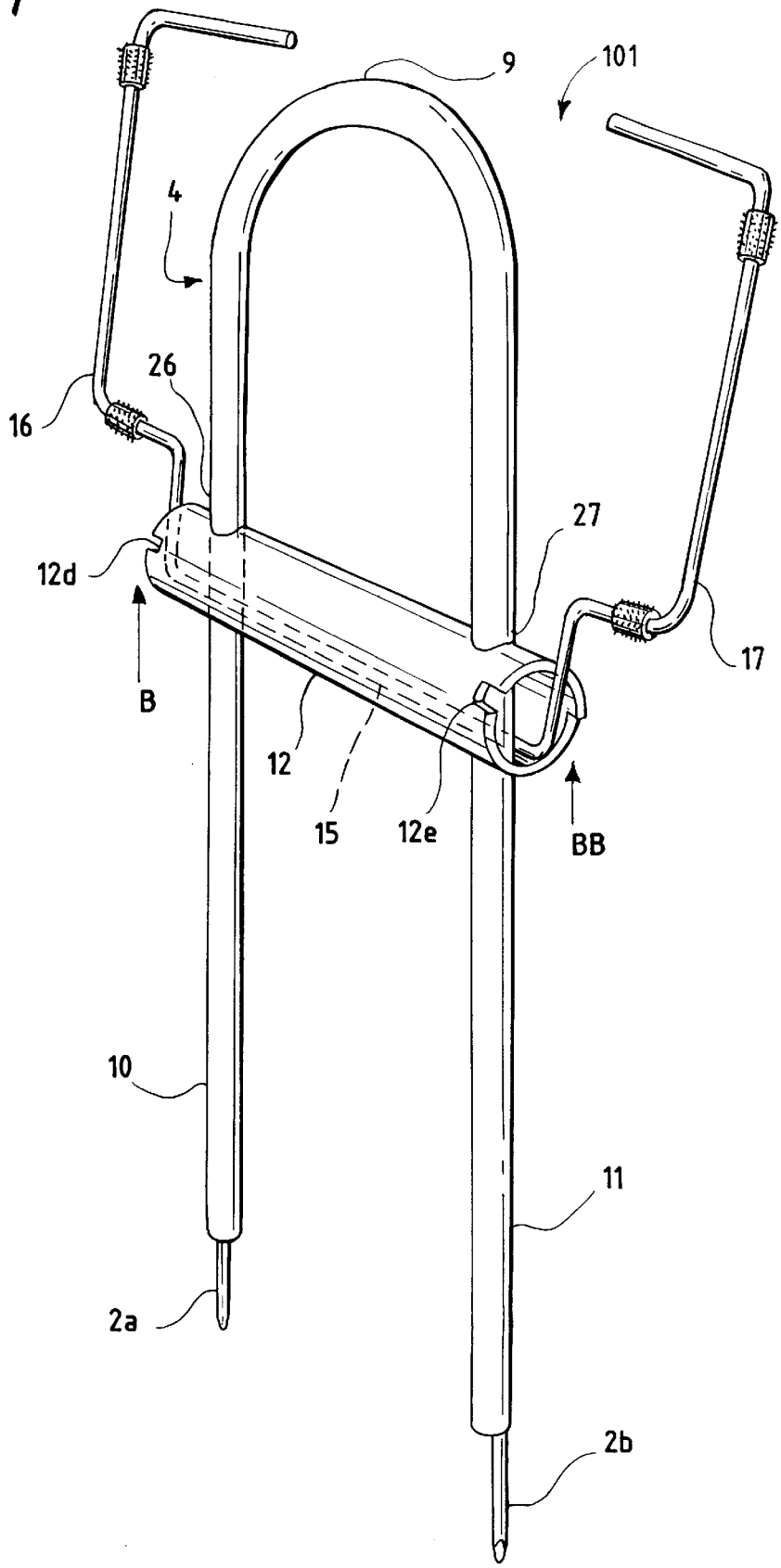

FIG. 7: Partial side view of bag holder attachment demonstrating vertical movement by upward force upon cylindrical hollow transverse PVC piping along legs.

Figure 8:
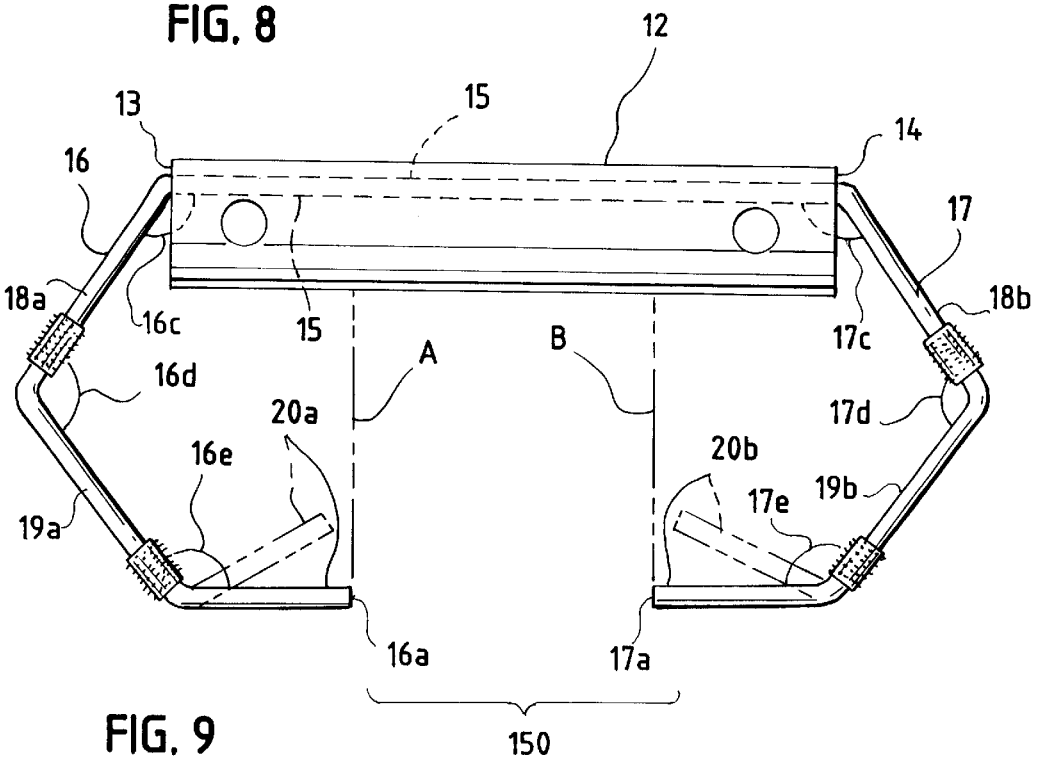

FIG. 8: Upper plan isolated view of angled arms and straight segment within transverse hollow PVC cylindrical piping.

Figure 9:
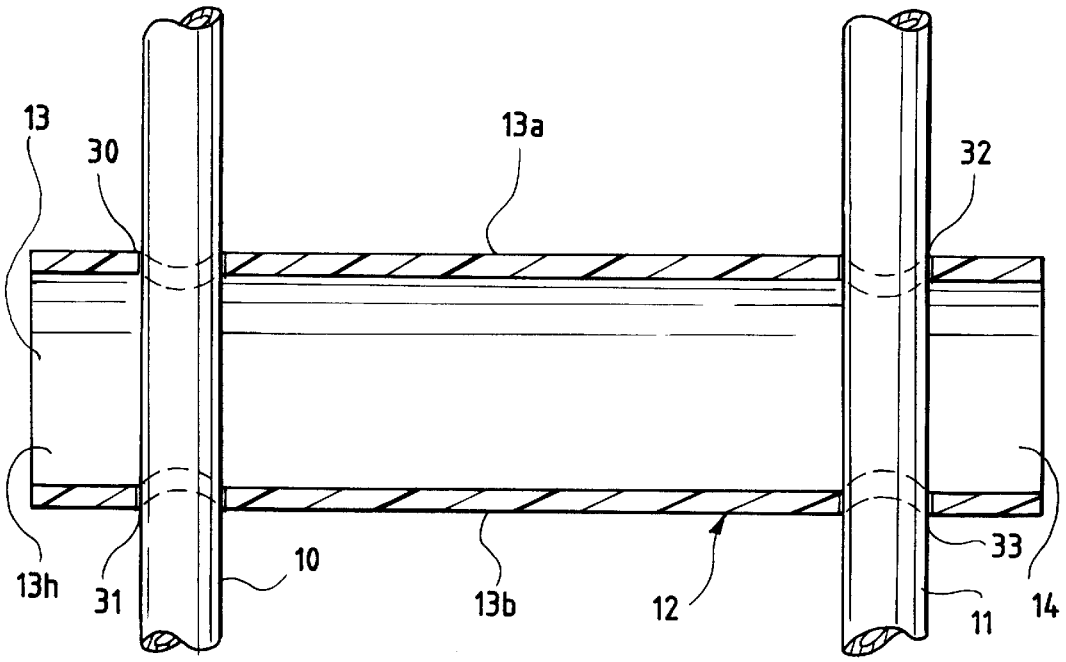

FIG. 9: Front cross-sectional illustration of legs penetrating transverse hollow PVC cylindrical piping.

IN THE DETAILED DESCRIPTION OF THE PREFERRED EMBODIMENT AND OTHER EMBODIMENTS

Preferred Embodiment:

My invention is a straightforward mechanical device, in all its embodiments, including the preferred embodiment, universal bag holder 1. Please see FIG. 1(*a*). My improved bag holder 1(*a*) in the preferred embodiment is supported by a pair of feet 2*a*, 2*b*. Each foot 2*a*, 2*b* is approximately ⅛ inch in diameter of spring steel or similar material. Point 2*d* of each foot 2*a*, 2*b* is beveled by grinding or a hacksaw wheel. Each foot 2*a*, 2*b* is approximately five (5) inches long.

Beveled feet 2*a*, 2*b* are easily sunk into the ground for support, even when the ground is frozen. As seen in FIG. 3, spring steel rod 7 is sufficiently flexible for insertion through hollow steel conduit rod 8 which comprises curved rigid vertical support structure 4. Also seen in FIG. 3 is spring steel rod 7 within the hollow steel cylindrical conduit 8 in the preferred embodiment 1. Steel spring rod 7 is cntiguous within curved vertical support 4.

Spring steel rod 7 is originally a linear rod with a first end 8*e* and a second end 8*f*. Spring steel rod 7 is approximately one-eighth inch in diameter. It traverses entire hollow interior 8*c* of steel conduit 8, bends within curved vertical support 4, and protrudes from each straight leg 10, 11. Spring steel rod 7 is manually pushed through conduit steel 8 prior to the process of bending into a curve. Spring steel rod 7 and hollow steel conduit 8 are easily bent simultaneously by methods well known to those skilled in the art.

As seen in FIG. 3, spring steel rod 7 comprise feet 2*a*, 2*b* and continuously and completely traverses hollow steel conduit 8. Hollow steel conduit 8 comprises curved rigid vertical support 4 of my invention in the preferred embodiment. Using curved rigid vertical support 4, mechanical bag holder 1 can raise an empty collapsed bag or other appropriate container, as the operator fills it manually or by other means.

Referring again to FIG. 1, the structural backbone of the preferred embodiment of my bag holder 1 is vertical steel curved support 4. In the preferred embodiment, thin walled steel conduit 8 comprises the curved vertical rigid support 4 material of choice. Thin walled steel conduit 8 has an inner wall 8*a* and an outer wall 8*b*, with a contiguous cylindrical hollow interior 8*c*. Thin-walled steel conduit 8 is approximately one-fourth inch in inner diameter.

Curved rigid vertical support 4 is approximately 45 (forty-five) inches in height from top point 9 to bevel 2*d* on feet 2*a*, 2*d* respectively. However, plastics, wood or light metals such as aluminum are satisfactory for vertical curved rigid support structure 4. Combinations of these materials are also acceptable in other embodiments. Electrical steel conduit for producing a vertical curved rigid support 4 is obtainable from:

Midwest Instate Electrical Construction Co.

420 Remington Road

Schaumburg, Ill. 60173

Spring steel rod 7 is manually pushed though steel conduit 8. Each end of steel rod 7 protrudes from each straight leg 10, 11 approximately five inches. Each end 8*e*, 8*f* comprises foot 2*a*, 2*b* respectively which inserts into the ground. Spring steel rod 7, except for feet 2*a*, 2*b* cannot be seen from the exterior of bag holder 1. Spring steel rod 7 is more flexible with respect to ground insertion than is steel conduit 8.

As seen in FIGS. 1(*a*) and 3, curved vertical rigid support 4 has a topmost point 9. At topmost point 9, there is a radius of curvature of approximately 160 degrees in the preferred embodiment. In the preferred embodiment steel conduit 8 is bent to the proper curvature without kinks by methods well known to those in this particular art. Thin wall steel conduit 8 curves and gradually become straight legs 10, 11 on either side of curvature 9*a*. Straight legs 10, 11 are parallel to each other along their vertical lengths and when curved rigid vertical support 4 is standing upright. The width of bag-holder 1 between first straight leg 10 and second straight leg 1 is approximately 8 and ½ inches in the preferred embodiment.

The diameter of upper curved section 9*b* of curved vertical support structure 8 is approximately nine (9) inches in the preferred embodiment. The half-circumference of upper curved section 9*b* of curved vertical support structure 8 is approximately 22 inches in the preferred embodiment.

The length of each straight leg segment 10, 11 is approximately 2 and ½ feet.

Referring now to FIGS. 1(*a*) and 1(*b*), at right angles to curved rigid vertical support 4 is a first cylindrical transverse polyvinyl chloride(PVC) hollow piping 12.

First transverse PVC hollow cylindrical piping 12 has an inner wall 12*a*, outer wall 12*b* and a continuous hollow interior 12*c*.

Hollow PVC transverse piping 12 has two ends 13 and 14. The length of transverse PVC cylindrical hollow piping 12 is approximately 11 and ½ inches in the preferred embodiment. There are two notches 12*d*,12*e*, each on opposite ends 13, 14 respectively of first transverse PVC hollow cylindrical piping 12. In the preferred embodiment the material of choice is first hollow polyvinyl chloride piping of approximately two and one-half inches diameter. First transverse cylindrical PVC hollow piping 12 has an upper surface 13*a* and a lower surface 13*b*. It also has an interior surface 13*c*, exterior surface 13*d*, anterior surface 13*e* and posterior surface 13*f*.

As seen in FIG. 2 and FIG. 9, approximately two inches to three inches from where end 13 terminates, leg 10 of curved vertical support 4 pierces upper surface 13*a* and continues downwardly to pierce lower surface 13*b* of first transverse cylindrical PVC piping 12. Similarly, leg 11 of curved vertical steel support 4 pierces upper surface 13*a* approximately two to three inches from end 14 and continues downwardly to pierce lower cylindrical surface 13*b*.

In this manner first transverse hollow polyvinyl chloride piping 12 is physically attached to vertical rigid curved support 4 by legs 10 and 11. Legs 10 and 11 remain straight segments from the transitional points 26,27 of upper curved segment 9*a* to feet 2*a*, 2*b* in the preferred embodiment. Please see FIG. 9. As a result, there are four junctions in the preferred embodiment: junctions 30, 31 on end 13 and junctions 32,33 on end 14.

Vertical curved support 4 comprises a topmost point of curved segment 9; curved segment 9 also has a first transitional point #26 and a second transitional point 27 where straight legs 10, 11 begin.

In FIG. 8, straight segment 15 emerges from either end 13, 14 of first hollow transverse cylindrical PVC piping 12. When straight segment 15 emerges from end 13 it becomes angled arm 16 which has an outermost distal end 16*a*. Similarly, a second portion of straight segment 15 which emerges from end 14 is angled arm 17 and hap an outermost distal end 17*a*. In the preferred embodiment each angled arm 16, 17 has three angles.

However, more or less than three angles per arm are also within the scope of my invention.

Again referring to FIGS. 1 and 8, angled arms 16, 17 comprise solid steel rods which are ¼ inch in diameter in the preferred embodiment. First angled arm segments 18*a*, 18*b* emerge from ends 13, 14 respectively, and each segment 18*a*, 18*b* is approximately 7 (seven) inches long. Each second intermediate segments 19*a*, 19*b* of each angled arm 16, 17 respectively, is approximately 9 (nine) inches in length. Each third terminating segment 20*a*, 20*b* of each angled arm 16, 17 respectively is approximately 4 and ½ inches in length.

The distance between distal ends 16*a*, 17*a* in the preferred embodiment is from approximately eighteen inches to approximately 26 inches when no bag or container 3 is attached. Most preferably this distance from 16*a* to 17*a* is approximately 20 inches. Each outermost distal end 16*a*, 17*a* of angled arm 16, 17 extends anteriorly from first PVC transverse cylindrical piping approximately fifteen (15) inches in the preferred embodiment, as indicated by dotted lines A and B in FIG. 8. As seen in FIG. 8, terminal segments 20*a*, 20*b* can be initially bent at a variety of angles and still remain within the scope of my invention.

Again referring to FIG. 8, each angle 16*d*, 17*d* is approximately 120 degrees. Angles 16*e*, 17*e* are each approximately 130 degrees. Similarly, each uppermost angle 16*c*, 17*c* is 110 degrees when central segment 15 first exits from ends 13, 14 of first hollow cylindrical PVC transverse piping 12. Angled arms 16 and 17 are generally made of thin-walled steel conduit which can be hollow or solid.

Other suitable materials include, but not exclusively, aluminum, iron, and rubber and plastics of sufficient rigidity, and which are well known to those skilled in the art.

Angled arms 16, 17 are adjustable both laterally and vertically. Because of angled arms 16,17 an operator using bag holder 1 can simultaneously raise and maintain continuously open, what was originally an empty collapsed bag 3 or container 3*a*. The operator can adjust the bag height manually or by other means. As seen in FIG. 6*a*, when extended to the maximally anterior position and parallel to the ground, angled arms 16 and 17 form an adjustable polygonal member 20. The operator can then place a large bag 3 or other container 3*a* over angled arms 16,17 and underneath VELCRO® hook and loop material tabs 23. Please see also FIG. 1(*b*).

FIG. 9 illustrates in front cross-sectional view how junctions 30, 31, 32, 33 are formed. Central segment 15 traverses first PVC cylindrical transverse piping 12 anteriorly to intersections 30, 31, 32, 33 of straight legs 10, 11. Please see FIG. 2. Straight legs 10, 11 respectively penetrate upper surface 13*a* and lower surface 13*b* of first cylindrical hollow PVC transverse piping 12.

As seen in FIGS. 1(*a*), 1(*b*) angled arms 16, 17 in hooplike position 20 extend anteriorly from vertical rigid curved steel support 4. In the preferred embodiment, each angled arm 16, 17 reaches approximately 26 inches directly anterior to junctions 30, 31 and 32, 33. Please see FIG. 9. Again referring to FIG. 1(*b*), even with angled arms 16, 17 fully extended, there remains a gap 150 of approximately five (5) inches between outermost distal ends 16*a* and 17*a* respectively.

Gap 150 allows bag 3 or container 3*a* to slowly expand in a pouchlike manner 30*a* as seen schematically in FIG. 1(*b*). Bag 3 or container 3*a* can then fill to capacity past angled arms 16, 17. Angled arms 16, 17 are continuously and integrally connected through first transverse cylindrical PVC piping 12 by contiguous straight segment 15.

As seen in FIGS. 1(*a*), 1(*b*) and 6, VELCRO® hook and loop fastener tabs 23 completely encircle each arm 16, 17 adjacent to each angle 16*a*, 16*b*, 17*a*, 17*b*, 18*a*, 18*b*. These VELCRO® hook and loop fastener tabs assist the operator in maintaining bag 3 or container 3*a* in proper position over angled arms 16, 17.

VELCRO® hook and loop fastener tabs 23 are made primarily of plastic and cloth components. For purposes of my preferred embodiment or other embodiments, it is an 'off the shelf' item which is well known to those skilled in this particular art. VELCRO® hook and loop fastener material can be purchased from:

Velcro U.S.A., Inc.
406 Brown Ave.
Manchester, N.H. 03103
Telephone: 1-800-225-0180

VELCRO® hook and loop fastener material generally comprises a base sheet material from which stemlike projections extend. Suitable hoop materials generally comprise from approximately 300 to about 1000 hooks per square inch, preferably from about 700 to about 900 hooks per square inch. The hooks suitably have a height of about 0.015 inch, preferably about 0.025 inch to about 0.035 inch.

A suitable VELCRO® hook and loop fastener material is a fabric of raised loop construction, stabilized though napping and thermosetting, such that the loops are erect from base material. The fabric may be a two warp knit construction, preferably of polyester yarn. Approximately 15% to 35% of the yarn is composed of yarn having approximately 15 or less filaments. FIG. 6 is a closeup view of a VELCRO® hook and loop fastener strip completely encircling an angled arm 16, 17.

FIG. 8 also indicates in dotted lines, that third terminal MD segment 20*a*, 20*b* of each angled arm 16, 17 is preferably at an angle 16*e*, 17*e* of approximately 120 degrees with respect to second intermediate segment 19*a*, 19*b*. The distance anteriorly between first segment 18*a*, 18*b* of each angled arm 16, 17 and each third terminal segments 20*a*, 20*b* respectively is approximately ten inches in the most preferred embodiment.

The distance between second intermediate segments 19*a*, 19*b* respectively of angled arm 16 and second intermediate segment of angled arm 17 is preferably twenty-six inches.

In FIG. 6(*a*) angled arms 16, 17 are initially approximately 90 degrees to vertical curved rigid support 4. Angled arms 16, 17 are also initially approximately 90 degrees to supporting surface 8*a*, First transverse cylindrical hollow PVC piping 12 supports arms 16, 17 by straight segment 15 which transverses the entire length of piping 12, as seen in FIG. 8.

FIG. 6(*a*) also demonstrates operation of my universal bag holder 1 in a vertical movement of angled arms 16, 17. In the preferred embodiment the operator pulls the arms upward and places them in notches 12*d*, 12*e*. Angled arms 16, 17 open upwardly in robot-like fashion from their position parallel to the ground and posterior to curved vertical support 4. The uppermost position of each angled arm 16, 17 is determined by the position of notches 12*d*, 12*e* on ends 13, 14 of first transverse cylindrical hollow PVC piping 12.

FIG. 7(*b*) demonstrates the final position of angled arms 16, 17 which are now more closely parallel orientation to curved vertical rigid support 4. This is the optimum height to which the operator can raise bag 3 or container 3*a* by manipulating only angled arms 16, 17. This final position reduces the volume of my invention 1 for easier storage and transport.

FIG. 7 represents a partial front view of angled arms 16, 17 curved vertical support 4 and first hollow transverse PVC cylindrical piping 12. First hollow transverse PVC cylindrical piping 12 offers an additional method for raising angled arms 16, 17 along straight legs 10, 11.

To move bag 3 or container 3*a* in a vertical direction the operator raises entire first transverse PVC cylindrical piping 12 along straight legs 10, 11 to an uppermost predetermined position 101. Again referring to FIG. 7, this position is determined by where straight legs 10, 11 terminate and where contiguous physically integral curved segment 9*a* begins at transitional points 26, 27. This movement, together with upward movement of angled arms 16, 17 as described supra provides maximum vertical height for bag 3 or container 3*a*.

Straight segment 15 is an integral contiguous central portion between arms 16, 17. Straight segment 15 lies within and parallel to inner wall 12*a* of first transverse cylindrical PVC hollow piping 12. Straight segment 15 can swivel upwardly or downwardly, as shown in FIG. 2. FIG. 2 also illustrates first hollow PCV transverse cylindrical piping 12 with notches 12*d*, 12*e* at either respective end 13, 14.

Notches 12*d*, 12*e*, are located each end 13, 14 respectively of first PVC transverse cylindrical piping 12. Each notch 12*d*, 12*e* comprise an indentation in surface 12*b* and 12*a* of first hollow PVC cylindrical transverse piping 2.

FIG. 8 also illustrates a partial upper plan schematic view of first transverse rigid cylindrical PCV piping 12 and angled arms 16, 17.

Angled arms 16, 17 are integrally connected to, and physically contiguous with central segment 15. Central segment 15 cannot be seen from the exterior surface 12*a* of first transverse rigid cylindrical PCV piping 12, except at ends 13 and 14.

There is no obstruction or interference within hollow interior 13*h* of first transverse PVC hollow cylindrical piping 12, or transverse segment 15 and legs 10 and 11. Moreover, there is a mechanical advantage with each straight leg 10, 11 within first PVC transverse cylindrical piping 12:

straight legs 10, 11 aid in stabilizing the swiveling motion of central segment 15 while angled arms 16, 17 move in a vertical or downward direction.

For maximum width in a horizontal position parallel to the supporting surface, angled arms 16, 17 have limited lateral movement perpendicular to vertical movement described immediately supra. However, as seen in FIG. 1(*b*), bag 3 or container 3*a* can expand through gap 150 in a pouchlike fashion. This expansion is particularly significant for any bag or container 3, 3*a* which is comprised of a material such as plastic, with elastic or stretch or elastic memory. Gap 150 between distal ends 16*a*, 17*a* of angled arms 16, 17 prevents spilling of debris if bag 3 or container 3*a* is slightly larger that the area partially enclosed by angled arms 17, 18.

This expansion is particular significant for any bag or container 3, 3*a* which is comprised of a material such as plastic, with elastic or stretch or elastic memory. Gap 30 between distal ends 16*a*, 17*a* of angled arms 16, 17 prevents spilling of debris if bag 3 or container 3*a* is slightly larger that the area partially enclosed by 3*a* angled arms 17, 18.

Second Embodiment:

For my second embodiment, FIG. 4(*a*) illustrates a front view of vertical rigid curved support 4 with a second pair of angled arms 50, 51. Angled arms 16, 17 protrudes anteriorly as in the preferred embodiment and with the same physical description and composition.

Second pair of angled arms 50, 51 protrudes posteriorly and approximately 180 degrees from the direction of angled arms 16, 17. As in the preferred embodiment, there is a singled curved vertical a rigid support 4 and a first transverse PCV cylindrical hollow piping 12.

Figure 4A:
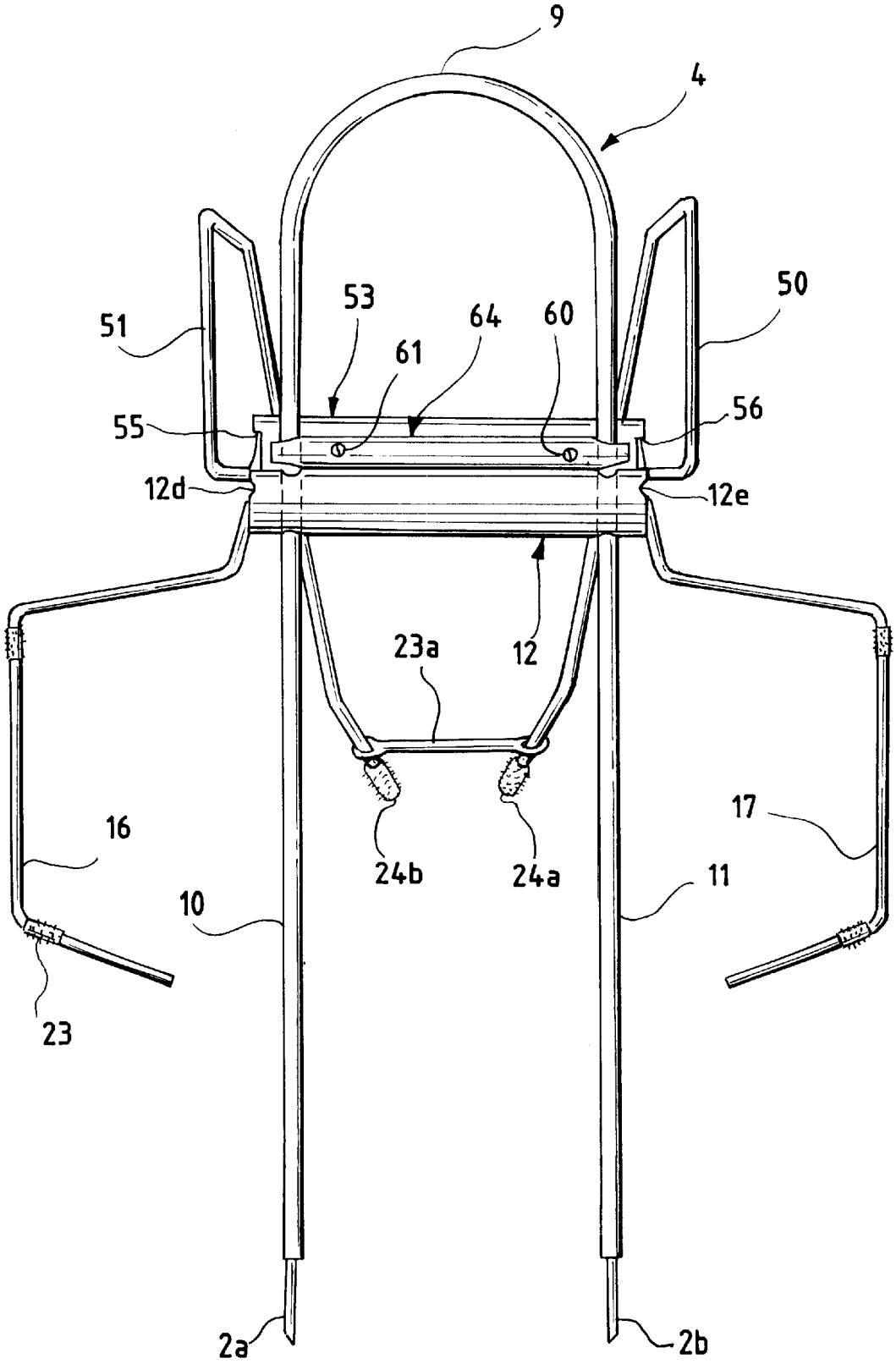
Figure 4B:
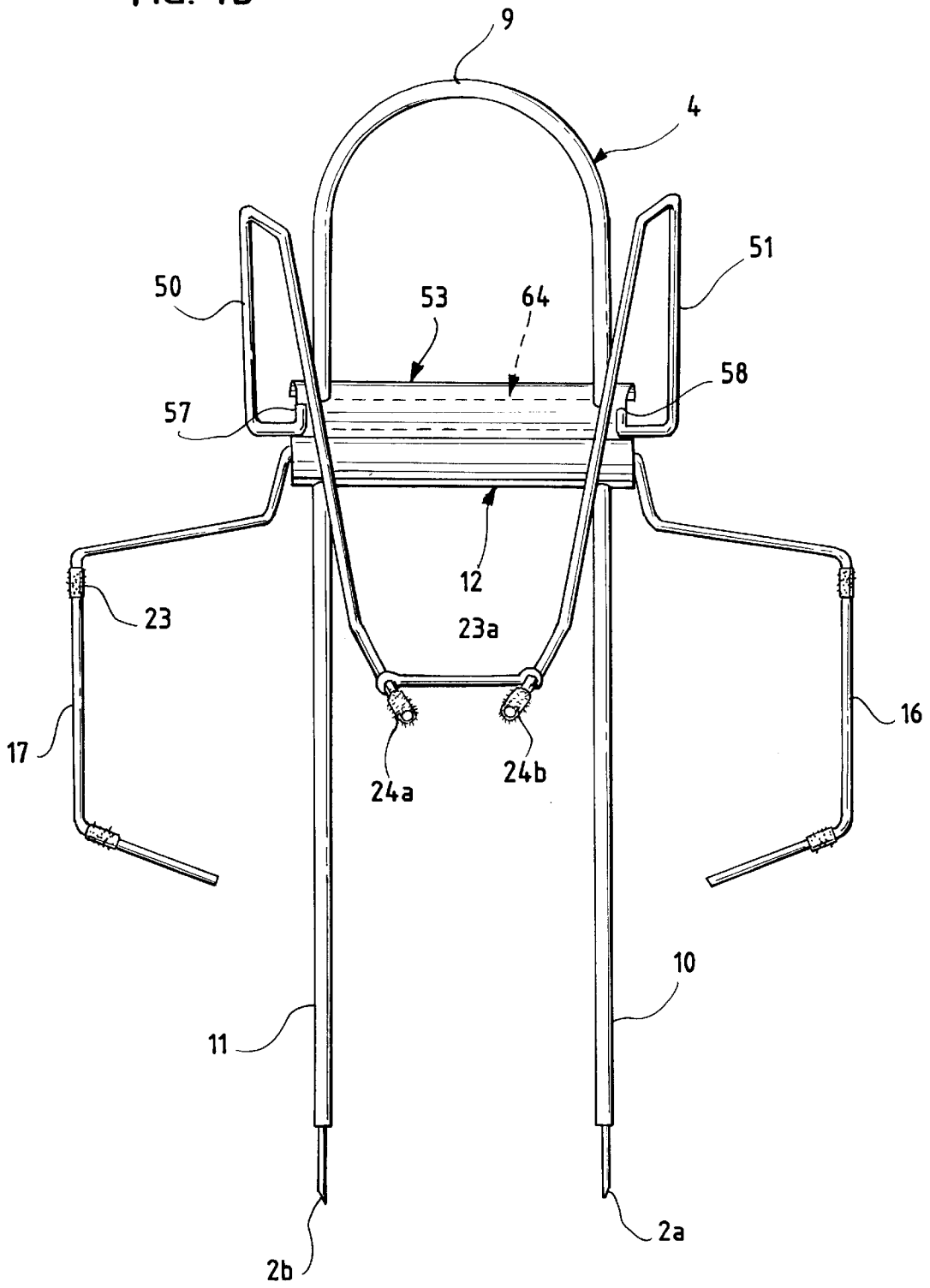
Figure 4C:
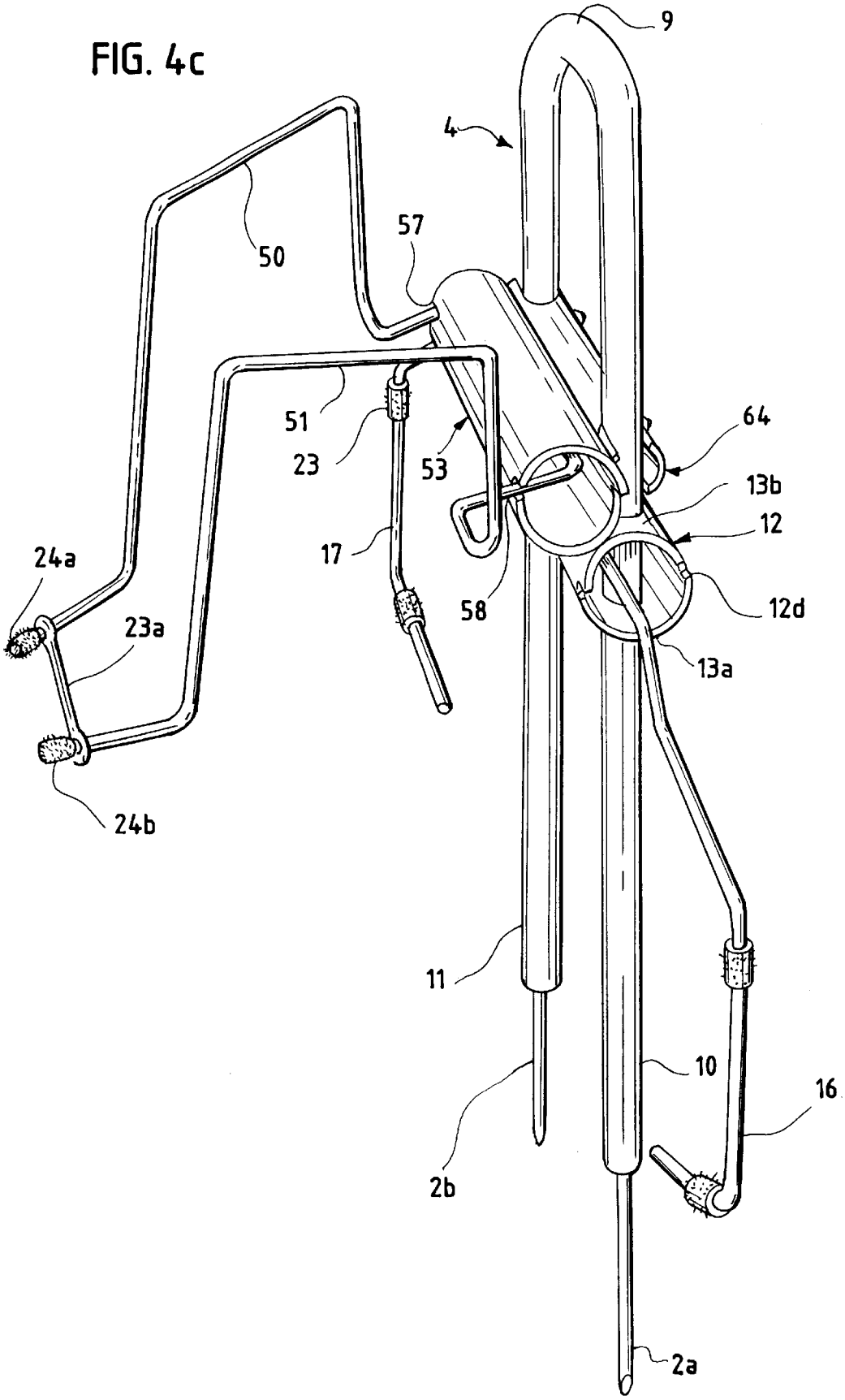
Figure 4D:
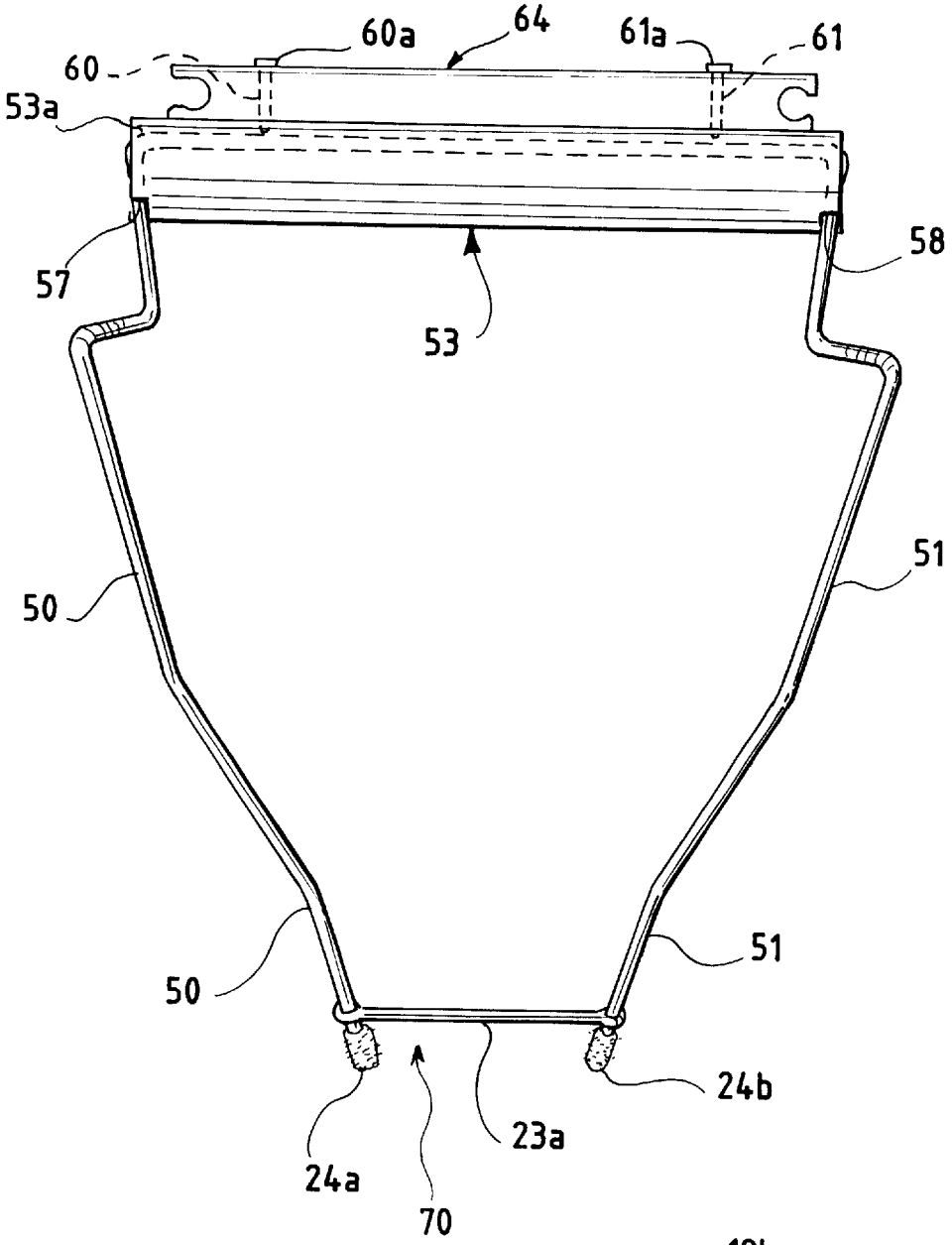

Also as in the preferred embodiment, there is spring steel rod 8, not seen in FIG. 4*a*, which terminates in feet 2*a*, 2*b*. To support angled arms 50, 51 there is a second transverse PVC hollow cylindrical pipe 53, each with an end 55, 56 respectively, and respective notches 57, 58. String tie 23*a* attaches angled arms 50, 51 at their most distal VELCRO® hook and loop material fastener covered ends 24*a*, 24*b*.

Second transverse PVC hollow cylindrical piping 53 is located immediately above first hollow transverse cylindrical PVC piping 12. However, second transverse PVC hollow cylindrical piping 53 is not penetrated in any way by straight legs 10, 11. However, cylindrical piping 53 does have an additional cylindrical component retainer 64, as seen in FIGS. 5(*b*) and FIG. 5(*c*).

FIG. 4(*b*) is a posterior view of this third embodiment with a double component second transverse cylindrical hollow component 53. Second hollow transverse cylindrical PVC piping 53 futher comprises two screws 60, 61 affixing to straight legs 10, 11. Posterior component 64 is physically attached along its length from ends 55 to 56 to second hollow transverse cylindrical piping 53, as seen in FIG. 4(*b*).

FIG. 4(*c*) illustrates in side view how second transverse PVC cylindrical rigid piping 53 is physically connected to posterior component 64. Posterior component 64 clasps curved rigid vertical support 4 along its length, but does not pierce it nor contain angled arms 50, 51. FIG. 4(*d*) is an isolated top plan view of second transverse PVC cylindrical piping 53. Posterior component 64 is physically and contiguously attached to second transverse PVC cylindrical hollow piping 53 and is parallel to it.

Screws 60, 61 penetrate, with protruding threaded stems 60*a*, 61*a* respectively (seen in phantom), posterior component 64 and upper surface 53*a* of second transverse hollow cylindrical piping 53.

Angled arms 50, 51 are generally in a horizontal or vertical dimension different from angled arms 16, 17. Angled arms 50, 51 generally protrude anteriorly from rigid curved support structure 4, then angle vertically, and finally reach toward each other.

Between distal ends 50*a*, 51*a*, there is a second gap 70 of approximately four inches. Lateral and vertical movements are the same mechanically as that described for the preferred embodiment herein.

CONCLUSIONS

Bag 3, most preferable for outdoor work, is known as a contractor's bag 3*b* and is well known to those skilled in this art. Each bag 3*b* is approximately 36 inches in diameter when maximally extended and approximately three feet maximum in height when angled arms 16, 17 are fully extended vertically. Contractor bags 3*b* are preferably made of stretchable biodegradable plastic. Bags 3*b* are three (3) ply and are reusable. Contractor bags 3*b* for my invention can be obtained from:

Poly-America Inc.
2000 West Marshall Drive
Grand Prairie, Tex. 75051

As described for the preferred embodiment and double bag attachment embodiment, one method by which an operator can manually raise arms 16, 17 requires seizing both ends of central segment 5 and raising each angled arm to lodge snugly in notches 12*d*, 12*e* respectively.

As a result bag 3 or container 3*a* is raised while filling, because it is attached to angled arms 16, 17 and/or 50, 51 and is pulled along with them. As bag 3 widens angled arms 16, 17 can be pulled laterally to a limited degree as bag 3 increases in volume.

The second method for raising bag 3 or container 3*b* vertically requires straight legs 10, 11. For example, first hollow rigid horizontal cylindrical PVC pipe 12 has a first end 13 and a second end 14. First end 13 is penetrated by leg 10 and second end 14 is penetrated by leg 11 as seen in FIG. 10.

Because of this feature, an operator can manually position both angled arms 16, 17 or angled arms 50, 51 simultaneously to the exact same vertical height along curved vertical support 4. For example, in the preferred embodiment, the operator grasps ends 13, 14 and moves first transverse hollow cylindrical PVC piping 12 upwardly to raise bag 3 in an upwardly vertical direction along straight legs 10, 11. Please see FIG. 7.

Similarly, the operator may wish to lower bag or container 3 upon angled arms 16, 17, or the angled arms 16, 17 without bag 3. For example, he or she again grasps ends 13, 14 and pulls first entire transverse hollow rigid cylindrical PVC piping 12 downwardly along each leg 10, 11 simultaneously. The same procedure applies for second hollow transverse cylindrical piping 52.

Again referring to the preferred embodiment, immediately after moving angled arms 16, 17 in a vertical direction, supra, angled arms 16, 17 can be moved in a horizontal direction to bag 3 becomes wider. The order of these movements in different planes can be reversed, of course. The more force the operator applies to angled arms 16, 17 in a pulling motion, the wider bag 3 or container 3*a* will become (particularly for a stretchable plastic bag).

My invention comprises all sizes and variations of my mechanical bag holder. For example a kitchen bag holder is adjustable with a thirteen gallon plastic bag.

None of my embodiments require assistance from devices such as screws or bolts, so ease of assembly, as well as economy are also advantages of my invention The above text describes exact measurements and angles of the preferred embodiment.

However, other angles and lengths, materials, diameters, depths and widths are also within the scope of my invention.

I claim:

1. A mechanical bag holder for holding and supporting bags and other containers, said mechanical bag holder suited for holding and supporting said bags and said containers while said bags or said containers are being filled with refuse or goods, said mechanical bag holder comprising:

(A) a curved rigid vertical support structure comprising an upper curved segment with a topmost point, (1) said curved segment having a first transitional point and a second transitional point, said curved rigid vertical support structure further comprising (a) a first straight leg and a second straight leg, (b) each said first straight leg and said second straight leg being contiguously connected to said first transitional point and said second transitional point respectively, (2) said first straight leg and said second straight leg being parallel to each other when said curved rigid vertical support structure is standing upright, (B) a first cylindrical transverse polyvinylchloride hollow piping, said first cylindrical transverse polyvinylchloride hollow piping comprising (1) a first end and a second end, (a) said first end physically attached to said first straight leg and said second end physically attached to said second straight leg, (2) said first cylindrical transverse polyvinylchloride hollow piping being at a right angle to said curved rigid vertical support structure, (C) a first straight segment extending within said first cylindrical transverse polyvinylchloride hollow piping, (1) said straight segment comprising a first angled arm and a second angled arm, (a) said first angled arm emerging from said first end of said first cylindrical transverse polyvinylchloride hollow piping and (b) said second angled arm emerging from said second end of said first cylindrical transverse polyvinylchloride hollow piping, whereby said curved rigid vertical support structure supports said straight segment within said first transverse polyvinylchloride hollow cylindrical piping such that said straight segment can be swiveled within said first transverse polyvinylchloride hollow cylindrical piping, thereby causing said first angled arm and said second angled arm to be moved vertically or laterally while supporting said bag or container.

2. The mechanical bag holder as described in claim 1 wherein said curved rigid vertical support structure is comprised of hollow steel conduit, said hollow steel conduit further comprising a spring steel rod.

3. The mechanical bag holder as described in claim 2 where said first transverse hollow polyvinylchloride cylindrical pipe is approximately 2 and ½ inch in diameter and approximately eleven and one-half inches in length.

4. The mechanical bag holder as described in claim 3 wherein said angled arms further comprise removable strips, said removable strips comprising a hook and loop fastener of raised loop construction, said angled arms comprised of thin-walled steel conduit.

5. A mechanical bag holder as described in claim 4, said mechanical bag holder further comprising a second transverse cylindrical hollow polyvinylchloride piping, (A) said second transverse cylindrical hollow polyvinylchloride piping further containing (1) a second straight segment, said second straight segment comprising a second pair of angled arms (2) said second transverse cylindrical hollow polyvinylchloride piping located parallel to and immediately above said first transverse cylindrical hollow polyvinylchloride piping, said second transverse cylindrical hollow polyvinylchloride piping being physically attached to said curved rigid vertical support structure.

6. The mechanical bag holder as described in claim 4 wherein each said first straight leg and second straight leg comprise a lower end, each said lower end further comprising a beveled foot.

7. A mechanical bag holder for holding and supporting bags and other containers, said mechanical bag holder suited for holding and supporting said bags or containers while said bags or said containers are being filled with refuse or goods, said mechanical bag holder further comprising:

(A) a curved rigid vertical support structure, said curved rigid vertical support structure comprising (1) an upper curved section with a topmost point, said upper curved section having a first transitional point and a second transitional point, (2) said curved rigid vertical support structure further comprising a first straight leg and a second straight leg, each said first straight leg and said second straight leg being contiguously connected to said first transitional point and said second transitional point respectively of said upper curved section, (B) a first cylindrical transverse polyvinylchloride hollow piping, said first cylindrical transverse polyvinylchloride hollow piping comprising (1) a first end and a second end, (a) said first end physically attached to said first straight leg and (b) said second end physically attached to said second straight leg, (2) said first cylindrical transverse polyvinylchloride hollow piping being at a right angle to said curved rigid vertical support structure, (C) a first straight segment traversing within said first cylindrical transverse polyvinylchloride hollow piping, said straight segment comprising (1) a first angled arm and a second angled arm, said first angled arm emerging from said first end of said first cylindrical transverse polyvinylchloride hollow piping and said second angled arm emerging from said second end of said first cylindrical transverse polyvinylchloride hollow piping, (D) a second cylindrical transverse polyvinylchloride hollow piping, said second cylindrical transverse polyvinylchloride hollow piping comprising (1) a first end and a second end, said first end physically attached to said first straight leg and said second end physically attached to said second straight leg, (2) said second cylindrical transverse polyvinylchloride hollow piping being at a right angle to said curved rigid vertical support structure, said second cylindrical transverse polyvinylchloride hollow piping being immediatelly above said first hollow transverse polyvinylchloride cylindrical piping, (E) a second straight segment extending within said second cylindrical transverse polyvinylchloride hollow piping, said second straight segment comprising (1) a third angled arm and a fourth angled arm, (a) said third angled arm emerging from said first end of said second cylindrical transverse polyvinylchloride hollow piping and (b) said fourth angled arm emerging from said second end of said second cylindrical transverse polyvinylchloride hollow piping, whereby said first angled arm and said second angled arm can support a bag being filled, while simultaneously said third angled arm and said second angled arm can support a bag while being filled, all said angled arms supported by said singled curved vertical rigid support structure.

* * * * *